US005296169A

United States Patent [19]

Ochi et al.

[11] Patent Number: 5,296,169

[45] Date of Patent: Mar. 22, 1994

[54] METHOD OF PRODUCING VARISTOR

[75] Inventors: Hideo Ochi, Misato; Akihide Igari; Masaaki Toyoda, both of Saitama; Zenbee Nakagawa, Yokohama, all of Japan

[73] Assignee: Somar Corporation, Japan

[21] Appl. No.: 942,392

[22] Filed: Sep. 9, 1992

[30] Foreign Application Priority Data

Jan. 29, 1992 [JP] Japan ..... 4-40102

[51] Int. Cl.[5] ..... H01B 1/06

[52] U.S. Cl. ..... 252/518; 264/61; 264/65

[58] Field of Search ..... 264/61, 65; 252/518

[56] References Cited

U.S. PATENT DOCUMENTS 4,618,592 10/1986 Kuramoto ..... 264/61
5,073,302 12/1991 Igari et al. ..... 252/518
5,076,979 12/1991 Ochi et al. ..... 264/61
5,116,542 5/1992 Ochi et al. ..... 264/61

FOREIGN PATENT DOCUMENTS 46-23310 7/1971 Japan .

*Primary Examiner*—James Derrington
*Attorney, Agent, or Firm*—Lorusso & Loud

[57] ABSTRACT

A varistor having a non-linear coefficient of at least 40 and improved stability for DC stress is produced by a method including a step of mixing ZnO powder with a solvent solution of Mn and Pb compounds, a step of calcining the resultig mixture, and a step of pulverizing the calcined product to obtain a pulverized product. These steps are performed while preventing the contamination with a Group IIIb or Ia element, so that the pulverized product has MnO and PbO contents of 3-7 mole % and 0.003-0.01 mole %, respectively, and a content of impurity compounds of a IIIb or Ia element of not greater than 20 ppm by weight. The pulverized product is molded and sintered to obtain the varistor.

4 Claims, No Drawings

METHOD OF PRODUCING VARISTOR

BACKGROUND OF THE INVENTION

This invention relates to a method of producing a zinc oxide varistor and, more particularly, to a method of readily producing a zinc oxide varistor having excellent electrical properties and improved stability for DC (direct current) stress.

Zinc oxide varistors are polycrystaline ceramics which exhibit highly non-linear current-voltage characteristics, and widely applied to home appliances, factory devices, power transmission lines and other many kinds of instruments having electrical circuits, to protect them from damages to power surges by taking advantage of the nonlinearity between current and voltage of a varistor. The relationship between the current and voltage of a zinc oxide varistor is expressed by the following empirical equation:

$$I=(V/C)^{\alpha}$$

where I is the current flowing through the varistor, V is the voltage applied to the varistor, C is constant and $\alpha$ (alpha) is a non-linear coefficient greater than 1, and is a measure of the non-linearity of the resistance characteristic of the varistor. It is generally desired that alpha is relatively high. Alpha is calculated according to the following equation:

$$\alpha=\log(I_1/L_2/\log(V_1/V_2)$$

where $V_1$ and $V_2$ are the voltages at given currents $I_1$ and $I_2$, respectively. $I_1$ and $I_2$ are generally determined at 1 mA and 10 mA, respectively, and $V_1$ is called a varistor voltage.

Zinc oxide varistors are usually produced as follows:

A plurality of additives are mixed with a powdered zinc oxide. Typically, 4 to 12 additives are employed.

The types and amounts of additives employed vary with the properties sought in the varistor. The additives are usually metal oxides such as $Bi_2O_3$, CoO, MnO, $Sb_2O_3$, $Cr_2O_3$, $SnO_2$, $Al_2O_3$, $TiO_2$ and $SiO_2$. In some cases, metals and metal halides, which are converted to metal oxides by firing under the air, are also used as additives instead of the metal oxides. The amounts of additives are usually very small as compared with zinc oxide. In most cases, amounts of all together additives are less than 5 to 10 mole % of the mixture of additives and zinc oxide.

A portion of the zinc oxide and additives mixture is then pressed into a body of desired shape and size.

Next, the body is sintered at appropriate temperature.

Subsequently, the sintered body is attached with electrodes and leads, then encapsulated by conventional methods. Thus, a varistor is formed.

The conventional methods for the production of a zinc oxide varistor suffer from a serious problem.

That is to say, the properties of a varistor would widely vary, which make it impossible to efficiently produce varistors of constant properties. This problem might be caused by the fact that there are many kinds of additives to be used and these additives are not mixed uniformly with zinc oxide powder as well as each other.

Furthermore, it is difficult to keep the respective purity and particle size distribution of so many kinds of additives in the constant ranges from lot to lot.

Thus, it is highly difficult to uniformly control the microstructure and the micro distribution of chemical components of the varistor comprising many components at high reproducibility.

SUMMARY OF THE INVENTION

In order to overcome the above-mentioned problem observed in conventional zinc oxide varistors, the inventors of the present invention have examined a number of formulations and process conditions for producing zinc oxide varistors. As a result, the inventors of the present invention have found that a varistor having a high alpha can be obtained by using zinc oxide, i.e., the main component, together with only one additive (a manganese compound), mixing said components, sintering the obtained mixture. The inventors of the present invention have already filed this process for producing the varistor having a simple composition (U.S. Pat. Nos. 5,073,302 and 5,076,976). However, known zinc oxide varistors have another problem in the stability thereof. It is known that the varistor characteristics such as specific resistivity in the low-current linear region and varistor voltage of a varistor tends to degradate by continuous DC stress. The inventors of the present invention have subsequently studied to overcome this problem, and have found that it is possible to improve the stability of the varistor, which comprises a zinc oxide and a manganese compound, for DC stress by adding a very small amounts of lead compound (less than 0.01 mole %) to the starting mixture as another additive.

Accordingly, it is the object of the present invention to provide a simple method of producing a zinc oxide varistor having a high alpha and a high stability for DC stress. The present invention provides a simple method of producing a varistor having a high alpha and a high stability for DC stress, which comprises the steps of:

mixing zinc oxide powder with solutions of a manganese compound and a lead compound to obtain a powder mixture, calcining the obtained mixture at a temperature of 600°-900° C. to obtain a calcined product, pulverizing the calcined product to obtain the pulverized product.

The mixing, calcining and pulverizing steps are performed while preventing contamination with impurity compounds of an element belonging to group IIIb or Ia of the Periodic Table so that the pulverized product has a content of impurity compounds of an element belonging to group IIIb or Ia of the Periodic Table of not greater than 20 ppm by weight. The amounts of the zinc oxide, manganese compound and lead compound are adjusted so that the pulverized product has MnO and PbO contents of 3-7 mole % and 0.003-0.01 mole %, respectively, based on the total amount of ZnO, MnO and PbO. The pulverized product is molded to obtain a body of desired shape and size. Next, the body is sintered at a temperature of 1100°-1300° C. in an oxygen-containing atmosphere. Subsequently, the sintered body is attached with electrodes and leads, then encapsulated by the conventional methods.

Japanese Examined Patent Publication No. 46-23310 also discloses a zinc oxide varistor containing 0.01-10 mole % of MnO and 0.01-10 mole % of PbO. The maximum alpha disclosed is, however, only about 6.5.

It is described that a PbO content more than 0.01 mole % is necessary since otherwise alpha is decreased.

On the contrary, in the present invention a PbO content less than 0.01 mole % is necessary since otherwise the stability of the varistor for DC stress is decreased.

The Japanese Patent does not mention about the effect of a PbO on the stabilization of a zinc oxide varistor for DC stress at all. The difference in the effect of PbO on the characteristics of the zinc oxide varistor between the Japanese Patent and the present invention is considered to be attributed to the presence of impurities in the varistor of the Japanese Patent, though the Japanese Patent is silent with respect to the impurities.

Other objects, features and advantages of the present invention will become apparent from the detailed description of the preferred embodiment of the invention to follow.

DETAILED DESCRIPTION OF THE PREFERRED EMBODIMENT OF THE INVENTION

The varistor according to the present invention has a composition including ZnO, MnO and PbO wherein the contents of MnO and PbO are 3-7 mole % and 0.003-0.01 mole %, respectively, based on the total mole of ZnO, MnO and PbO. The amount of PbO is preferably 0.003-0.007 mole %. Preferably, the molar ratio of PbO/MnO is about 1/1000. It is important that the amount of impurity metal oxides, especially those belonging to Group IIIb or Ia of the Periodic Table, e.g., B, Al, Ga, In, Tl, Li, Na and K, should be 20 ppm by weight or less, preferably 10 ppm by weight or less.

The varistor material of the present invention may be produced as follows. First, ZnO powder and solvent solutions of a manganese compound and a lead compound are homogeneously mixed with each other. The ZnO powder has an average particle diameter of generally not greater than 1 μm, preferably not greater than 0.5 μm. The use of a highly pure ZnO powder is recommendable. Such ZnO powder is commercially available. Since commercially available, high grade ZnO powder generally contains about 0.001 % by weight of PbO, it is recommendable to previously quantitatively analyze the raw material ZnO powder and to determine its PbO content so that the amount of PbO in the final varistor product is controlled within a predetermined range.

Any manganese compound may be used for the purpose of the present invention as long as it is soluble in a solvent and can be converted into MnO upon calcination. Examples of suitable manganese compounds include manganese nitrate and manganese acetate. Any lead compound may be used for the purpose of the present invention as long as it is soluble in a solvent and can be converted into PbO upon calcination. Examples of suitable manganese compounds include lead nitrate and lead acetate. Illustrative of suitable solvents for manganese and lead compounds are water, methanol, ethanol and methyl ethyl ketone. The use of a solvent which is easily vaporizable and in which ZnO is substantially insoluble is preferable. The manganese compound and lead compound may be dissolved in the same solvent or different solvents to form a single solution or separate solutions.

The thus obtained wet mixture is dried by removal of the solvent and the dried mixture is calcined at a temperature of 600°-900° C., preferably 600°-800° C., in an oxygen-containing atmosphere. A calcination temperature of below 600° C. is insufficient to effect the reaction of the ZnO powder with the manganese compound and lead compound. When the calcination temperature exceeds 900° C., fusion of the ZnO powder tends to occur.

The calcined mass is then pulverized into particles of an average particle diameter of, for example, 2 μm or less, preferably 1 μm or less.

In the method according to the present invention, it is important that contamination of the varistor with impurity metal compounds, especially those containing metals belonging to Group IIIb or Ia of the Periodic Table should be avoided. If such an impurity is contained in the varistor product, the varistor characteristics such as non-linear coefficient and the stability of the product are considerably deteriorated. The content of impurity compounds of an element or elements belonging to IIIb or Ia Group in the varistor product should be not greater than 20 ppm by weight.

Since contamination with such impurities are mainly caused during the mixing step of the starting materials and the pulverizing step of the calcined product, these steps should be performed while substantially preventing the contact of the raw materials to be mixed and the calcined mass to be ground with metal elements-containing surfaces. It is effective to use a synthetic resin pot mill or a pot mill lined with a synthetic resin, such as nylon or a polyurethane, in performing the mixing and pulverization. By this, the concentration of impurities of an element of IIIb or Ia Group can be controlled below 20 ppm by weight.

The pulverized product is subsequently molded into a desired shape, such as a disc or a sheet, and the shaped body is then sintered at a temperature within the range of 1,100°-1,300° C., preferably 1,100°-1,250° C., for about 0.5-3 hours in an oxygen-containing atmosphere so as to obtain a varistor material formed of grains having an average grain diameter of not greater than 5 μm. A sintering temperature of below 1,100° C. is insufficient to effect sintering within an acceptable period of time. When, on the other hand, the sintering is performed at a temperature of 1,300° C. or more, deformation of the sintered body is apt to occur.

The following examples will further illustrate the present invention.

EXAMPLE 1

ZnO powder (manufactured by Seido Kagaku Kogyo K. K., purity 99.85 %, average particle diameter: 0.5 μm) and a methylethyl-ketone solution of manganese nitrate ($Mn(NO_3)_2.6H_2O$) and an aqueous solution of lead nitrate ($Pb(NO_3)_2$) were charged in a pot mill lined with a polyurethane layer and were mixed with each other for 24 hours. The mixture, after the removal of majority of the solvents by evaporation, was dried at 120° C. for 15 hours and calcined, in a crucible, at 700° C. for 1 hour. The calcined mixture was wet-milled in the presence of methyl ethyl ketone using the above pot mill and dried. It was found that the contents of $Al_2O_3$ and other Group IIIb metal oxides and $Na_2O$ and other Group Ia metal oxides in the pulverized product were each less than 10 ppm by weight. The pulverized product was then shaped under a pressure of 300 kg/cm$^2$ into a disc with a diameter of 10 mm and a thickness of about 1 mm using molds whose inside surfaces were lined with a phenol resin. The disc was sintered at 1,100°-1,300° C. for 1 hour in air.

The resulting sintered disc was polished on both sides and applied with a coating of indium-mercury amalgam to form an electrode on each of the opposite surfaces for the measurement of its varistor voltage, non-linear coefficient and specific resistivity in the low-current linear region. Further, a direct current of 10 mA/cm$^2$ was charged to the electrode-bearing disc for 10 minutes and then for another 10 minutes at an interval of 15 minutes. Thereafter, the varistor voltage and specific resistance were measured. From the results of the varistor voltage and specific resistivity in the low-current linear rgion before and after the DC stress, the degree of variations (%) thereof was calculated.

The above procedure was repeated using various proportions of PbO and ZnO with the amount of MnO being maintained constant (5 mole %). The results were as summarized in Table 1.

TABLE 1

| Sample No. | Amount of PbO (mole %) | Varistor Voltage (V/mm) | Non-Linear Coefficient | Specific Resistivity (ohm · cm) | Degree of Variation: Varistor Voltage (%) | Degree of Variation: Specific Resistivity (%) |
|---|---|---|---|---|---|---|
| 1* | 0.000 | 1929 | 42 | $1.2 \times 10^{10}$ | 4.6 | −51.0 |
| 2 | 0.003 | 1214 | 47 | $4.2 \times 10^{8}$ | 1.3 | 6.6 |
| 3 | 0.005 | 1355 | 62 | $4.7 \times 10^{9}$ | 0.8 | 1.9 |
| 4 | 0.007 | 1557 | 44 | $1.0 \times 10^{10}$ | 1.7 | −1.0 |
| 5 | 0.010 | 1502 | 42 | $1.3 \times 10^{10}$ | 2.6 | −6.0 |
| 6* | 0.030 | 1205 | 40 | $1.0 \times 10^{9}$ | −4.5 | −25.3 |

*Comparative Sample

EXAMPLE 2

Example 1 was repeated in the same manner as described except that the amounts of MnO and PbO were changed as shown in Table 2. The results are also summarized in Table 2.

TABLE 2

| Sample No. | Amount (mole %): MnO | Amount (mole %): PbO | Varistor Voltage (V) | Nonlinear Coefficient | Specific Resistivity (ohm · cm) | Degree of Variation: Varistor Voltage (%) | Degree of Variation: Specific Resistivity (%) |
|---|---|---|---|---|---|---|---|
| 7 | 3 | 0.003 | 1409 | 49 | $3.9 \times 10^{10}$ | 1.3 | 2.0 |
| 8* | 3 | 0.000 | 1929 | 49 | $3.9 \times 10^{10}$ | 3.7 | 28.6 |
| 9 | 4 | 0.004 | 1266 | 47 | $1.9 \times 10^{10}$ | 1.2 | 1.5 |
| 10* | 4 | 0.000 | 2088 | 60 | $3.2 \times 10^{10}$ | 2.8 | 12.7 |
| 11 | 5 | 0.005 | 1355 | 62 | $4.7 \times 10^{9}$ | 0.8 | 1.9 |
| 12* | 5 | 0.000 | 1929 | 42 | $1.2 \times 10^{10}$ | 4.6 | −21.0 |
| 13 | 7 | 0.007 | 1851 | 55 | $4.5 \times 10^{9}$ | 0.7 | −3.1 |
| 14* | 7 | 0.000 | 2159 | 48 | $1.4 \times 10^{10}$ | 5.2 | −25.0 |

*Comparative Sample

EXAMPLE 3

Example 1 was repeated in the same manner as described except that aluminum nitrate ($Al(NO_3)_3$) and NaCl were further added in amounts shown in Table 3. The results are summarized in Table 3.

TABLE 3

| Sample No. | Amount: MnO (mole %) | Amount: PbO (mole %) | Amount: $Al_2O_3$ (ppm) | Amount: $Na_2O$ (ppm) | Non-Linear Coefficient | Varistor Voltage (V) | Degree of Variation of Specific Resistivity (%) |
|---|---|---|---|---|---|---|---|
| 15 | 5 | 0.005 | <10 | <10 | 62 | 1355 | 1.9 |
| 16 | 5 | 0.005 | 20 | <10 | 40 | 958 | −5.2 |
| 17* | 5 | 0.005 | 40 | <10 | 21 | 879 | −12.5 |
| 18 | 5 | 0.005 | <10 | 20 | 42 | 1420 | −8.3 |
| 19* | 5 | 0.005 | <10 | 40 | 28 | 1580 | −18.2 |

*Comparative Sample

What is claimed is:

1. A method of producing a varistor material, comprising the steps of:

(a) mixing zinc oxide powder with a solvent solution of a manganese compound and a lead compound to obtain a mixture;

(b) calcining said mixture at a temperature of 600°–900° C. in an oxygen-containing atmosphere to obtain a calcined product;

(c) pulverizing said calcined product, steps (a) through (c) being perfomed while preventing contamination with impurity compounds of an element belonging to Group IIIb or Ia of the Periodic Table so that a pulverized product having a content of impurity compounds of an element belonging to IIIb or Ia of the Periodic Table of not greater than 20 ppm by weight is obtained, said zinc oxide powder, manganese compound and lead compound being used in amounts so that said pulverized product has MnO and PbO contents of 3–7 mole % and 0.003–0.007 mole %, respectively, based on the total amount of ZnO, MnO and PbO;

(d) molding said pulverized product to obtain a shaped body; and (e) sintering said shaped body at a temperature of 1100°–1300° C. in an oxygen-containing atmosphere to obtain a sintered body.

2. A method as claimed in claim 1, wherein said manganese compound is manganese nitrate or manganese acetate, said lead compound is lead nitrate or lead acetate, and said solvent is water, methanol, ethanol or methyl ethyl ketone.

3. A method as claimed in claim 1, wherein step (a) and step (c) are performed with a milling device whose surface to be contacted with said zinc oxide powder and calcined product is formed of a synthetic resin.

4. A varistor produced by the method according to claim 1.

* * * * *

UNITED STATES PATENT AND TRADEMARK OFFICE

CERTIFICATE OF CORRECTION

PATENT NO. : 5,296,169

DATED : March 22, 1994

INVENTOR(S) : OCHI et al

It is certified that error appears in the above-indentified patent and that said Letters Patent is hereby corrected as shown below:

IN THE ABSTRACT:

Line 5, "resultig" should read --resulting--.

Col. 1, line 32, "$\alpha=\log(I_1/L_2/\log(V_1/V_2)$" should read --$\alpha=\log(I_1/I_2/\log(V_1/V_2)$--.

Col. 2, line 20, "5,076,976" should read --5,076,979--; and line 30, "amounts" should read --amount--.

UNITED STATES PATENT AND TRADEMARK OFFICE

CERTIFICATE OF CORRECTION

PATENT NO. : 5,296,169

DATED : March 22, 1994

INVENTOR(S) : Ochi et al

It is certified that error appears in the above-indentified patent and that said Letters Patent is hereby corrected as shown below:

Col. 5, line 8, "rgion" should read --region--.

Signed and Sealed this

Eighth Day of November, 1994

*Attest:*

BRUCE LEHMAN

*Attesting Officer*

*Commissioner of Patents and Trademarks*